US005601520A

United States Patent [19]

Wollner et al.

[11] Patent Number: 5,601,520

[45] Date of Patent: Feb. 11, 1997

[54] WEAR-RESISTANT HARD-SURFACING FOR THE ROLLS OF HIGH-PRESSURE ROLL PRESSES

[75] Inventors: Michael Wollner, Im Sohl; Ludger Alsmann, Köhn; Frank Fischer-Helwig, Am Löhe, all of Germany

[73] Assignee: Klöckner-Humboldt-Deutz AG, Cologne, Germany

[21] Appl. No.: 273,479

[22] Filed: Jul. 11, 1994

[30] Foreign Application Priority Data

Jul. 17, 1993 [DE] Germany ..... 43 24 074.7

[51] Int. Cl.[6] ..... B02C 4/30

[52] U.S. Cl. ..... 492/33; 492/36; 241/293; 241/300; 100/155 R

[58] Field of Search ..... 492/33, 36; 29/895.32; 100/155 R, 156, 158; 241/227, 293, 300

[56] References Cited

U.S. PATENT DOCUMENTS

| | | | |
|---|---|---|---|
| 4,915 | 5/1872 | Daniels | 241/293 |
| 412,558 | 10/1889 | Stephens | 241/300 |
| 3,156,968 | 3/1962 | White, Jr. | 29/895.32 |
| 3,412,946 | 11/1968 | Gabler et al. | 241/293 |
| 3,608,477 | 3/1969 | Weber et al. | 100/156 |
| 3,667,584 | 6/1972 | Karlsson | 492/36 |
| 5,203,513 | 4/1993 | Keller et al. | 241/300 |

FOREIGN PATENT DOCUMENTS

| | | |
|---|---|---|
| 0084383 | 7/1983 | European Pat. Off. . |
| 0443195 | 8/1991 | European Pat. Off. . |
| 3621747 | 6/1986 | Germany . |

*Primary Examiner*—Scott A. Smith
*Assistant Examiner*—Randolph S. Herrick
*Attorney, Agent, or Firm*—Hardaway Law Firm, P.A.; Charles L. Schwab

[57] ABSTRACT

In order to create a wear-resistant hard-surfacing for the rolls of high-pressure roll presses for the compressive size reduction of granular material, which is suitable for autogenous wear protection and which is simple from the fabrication standpoint and also exhibits a long potential surface life with minimized danger of cracking, even under the action of high pressing compressive loads, it is proposed in accordance with the invention that a multitude of profiles, such as, in particular, nub pins (17), arranged at intervals from one another, be welded onto the roll surface by mold welding, specifically with the assistance of a mold (11) laid on the roll body (10), which mold is provided with radial through openings (12, 13, 14), which are filled with surface weld metal, after which, after solidification of the weld metal, the preferably water-cooled mold (11) is lifted off the roll (10).

7 Claims, 1 Drawing Sheet

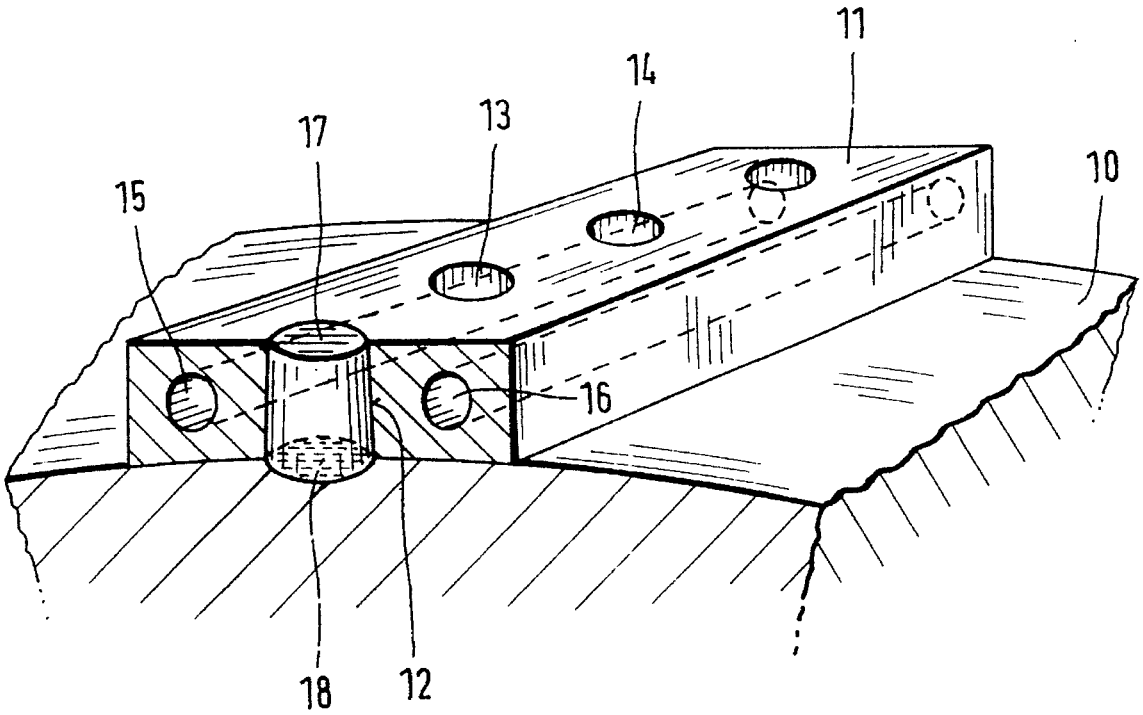
11
14
13
17
15
10
16
18
12

WEAR-RESISTANT HARD-SURFACING FOR THE ROLLS OF HIGH-PRESSURE ROLL PRESSES

TECHNICAL FIELD

This invention relates to a wear-resistant hard-surfacing for the rolls of high-pressure roll presses for the compressive size reduction of granular material, having a multitude of outwardly projecting profiles, in particular nub pins, attached to the roll surface at intervals from one another. Furthermore, the invention relates to a method for the application of such a roll surfacing.

BACKGROUND OF THE INVENTION

In roll crushers and roll mills, brittle grinding feed is drawn into the roll nip, by means of which the two rotatably supported counter-rotating rolls are separated from each other, and is there subjected to a compressive size reduction. So-called "attrition" size reduction is also known in the roll nip of a high-pressure roll press, in which the individual particles of the grinding feed drawn into the roll nip by means of friction are crushed against one another in the presence of an extremely high pressure in a bed of material, that is, in a pile of material pressed together between the two roll surfaces as achieved by machinery shown in European patent document EP-B 0 084 383. It is obvious that the roll surfaces in such a case are subjected to extraordinarily severe loading and to severe wear.

It is therefore known to make the surfaces of attrition size-reduction roll press wear-resistant by welding a multitude of profiles, such as prefabricated pin-shaped nub pins, to the roll surfaces, which profiles project outward from the roll surface to such a height, and are arranged at such close intervals from one another, that in the operation of the roll press the interstices or pockets between the nub pins remains filled with the compressed fine-grained feed material, which forms an autogenous wear protection for the roll surfaces as shown in FIGS. 4 and 5 of European patent document EP-A 0443 195. The welding on of such prefabricated hub pins is, however, possible only in the case of a pin material that can be surfaced by welding, such as constructional steel or the like. It would also be possible to insert the prefabricated nub pins into respective holes in the roll body and allow them to protrude from the roll body in hedgehog fashion. Such a solution would be expensive from a fabrication standpoint because of the chip-producing boring operations, and presents a risk of cracking, for example in the cylindrical surface of the roll, as a consequence of the high press pressure, which acts via the pin-shaped nub pins on existing notches such as, in particular, at the transition from the roll surface to the lateral, pin surface.

OBJECTS AND SUMMARY OF THE INVENTION

It is an object of the invention to create a wear-resistant hard-surfacing, in particular for the rolls of high-pressure roll presses for the compressive size reduction of granular material, which hard-surfacing is as suitable as possible for autogenous wear protection and is simple from the fabrication standpoint and also exhibits a long potential surface life and minimized danger of cracking, even under the action of high pressing compressive loads.

Characteristic of the roll surfacing in accordance with the invention is that the multitude of profiles applied to the roll surface, such as, in particular, nub pins, do not consist of prefabricated strips or pins that are then welded onto the roll shell or inserted into respective grooves/holes in the roll shell, but the profiles/nub pins are created by being mold-welded with the assistance of a mold, so that the profiles/pins consist only of the surface weld metal itself. For the preparation of the wear-resistant hard-surfacing in accordance with the invention, a mold adapted to the contour of the roll surface is laid on the roll body or on its rings/segments, which mold is provided with radial through openings, such as through holes (or also longitudinal slots), the size of which and the intervals between which corresponds to the field of the profiles, such as nub pins, and the radial through openings of the mold are then filled with surface weld metal, after which, after solidification of the weld metal, the mold is lifted off the roll.

In this fashion, the profiles projecting from the cylindrical surface of the roll, such as profile strips, in particular nub pins in the hard-surfacing in accordance with the invention, consist of weld metal melted by means of surface welding and solidified in the mold, with a good fusion-welded joint between the mold-welded profiles, such as nub pins, and the parent material of the roll. The danger of the occurrence of cracking extending deep into the roll body is minimized by this means. The alloying material or alloying materials of the mold-welded profiles, such as nub pins, at least in the radially outward regions, exhibit a high hardness of more than 50 HRC, for example 60 HRC (Rockwell C hardness test).

In accordance with a special feature of the invention, the mold has coolant channels, which are connectable to a supply and drain for the coolant, such as, for example, water. By means of the, in particular, liquid-cooled walls of the mold or of its weld-casting molds, microstructural modifications in the weld metal, specifically in the then solidified profiles, as well as microstructural properties thereof, such as hardness, toughness, wear resistance, etc., can be purposely adjusted. In every case, chip-producing preliminary operations such as boring, grooving, and so forth are avoided in the case of the hard-surfacing in accordance with the invention.

BRIEF DESCRIPTION OF THE DRAWINGS

The invention and its further features and advantages is explained in more detail on the basis of the exemplary embodiment illustrated schematically in the Drawing.

DETAILED DESCRIPTION OF THE DRAWINGS

The Drawing shows schematically, in section, the top side of the shell of a roll that is provided with the hard-surfacing in accordance with the invention. For this purpose, a mold (11), adapted to the contour of the roll surface and consisting, for example, of copper or a copper alloy, is placed on the surface of the roll body (10), which mold in the exemplary embodiment is beam-shaped and can extend, for example, over the entire width of the roll surface. The mold (11) is provided with radial through holes (12, 13, 14, etc.), the size of which and the intervals between which corresponds to the field of the nub pins. The mold (11) has cooling water channels (15, 16), which are connectable a supply and a drain for cooling water, which flows longitudinally through the mold. The radial through openings (12, 13, 14, etc.) are filled with surface weld metal, the mold (11) is lifted off the roll surface (10) after the solidification of the weld metal, and the mold-welded nub pins (17) produced in this fashion remain attached by a very strong fusion-welded joint (18) to the roll surface (10).

The height of the columnar nub pins (17) can be, for example, 8 to 10 mm and their diameter, for example, 15 mm. Adjacent nub pins (17) are arranged at such a close interval from one another, less than about 40 mm, that the interstices or pockets formed between the pins are so narrow that, in attrition size-reduction operation, these interstices or pockets between the pins are filled with compressed fine-grained material, which remains in the pockets as autogenous roll wear protection during the rotations of the roll.

The through holes (12, 13, 14, etc.) of the mold (11) can advantageously widen conically at a small angle from top to bottom, in order to facilitate the lifting of the mold (11) off the roll surface (10) after the mold-welding operation.

Wear-resistant alloys in the form of cored filler wires, welding rods, surfacing powder, and so forth, can advantageously be employed as material for the mold-welded profiles, such as hubs (17), etc., and plasma-arc powder surfacing as well as plasma-arc surfacing with external wire feed can also be used. Surface mold welding can be performed manually or in robotic fashion. Furthermore, the surface welding alloys used can be varied. There is, for example, the possibility of constructing the radially outward surface-weld passes or weld alloys of the mold-welded pins of a different (harder) alloying material from the radially inward surface-weld passes in each nub pin.

The mold (11) preferably consists of a material of sufficiently high thermal conductivity, high-temperature strength, and sufficiently high melting point, for example of copper or of a copper alloy. In special cases, such as, for example, the repair of damaged mold-welded nub pins, the mold can also consist of ceramic material.

The wear-resistant hard-surfacing of rolls in accordance with the invention is not restricted to nub pins as profiles. The profiles projecting outward from the roll surface (10) can also be web-shaped or strip-shaped bodies having a roughly rectangular cross section. In this case, the through openings of the mold (11) consist not of through holes but of corresponding through slots, which are filled with weld metal, after the solidification of which mold-welded web-shaped roll profiles are formed.

What is claimed is:

1. A high-pressure roll press comprising:

a roll having a roll surface (10);

a plurality of columnar nub pins (17) extending radially outwardly from said roll surface at predetermined intervals from one another, said nub pins being formed of two or more layers of deposited by surface weld passes on said roll surface through openings in a mold placed on said roll at the time of welding, the radially outward surface weld layers of said nub pins formed of alloying materials which are different from the alloying materials by which the radially inward surface weld layers of said nub pins are formed.

2. The high-pressure roll press of claim 1 wherein said nub pins are sufficiently close to one another that material crushed by said roll press packs the space between said nub pins thereby protecting said roll surface and reducing wear thereof.

3. The high-pressure roll press of claim 1 wherein said nub pins taper slightly to a diameter at their radially outer ends which is less than the diameter of said nub pins adjacent said roll surface, wherein said nub pins extend radially from said roll surface a distance substantially as great as two-thirds the diameter of said nub pins adjacent said roll surface and wherein said nub pins are spaced sufficiently close to one another to cause crushed material to pack between said nub pins thereby protecting said roll surface against excessive wear.

4. The high-pressure roll press of claim 1 wherein the radially outward layers of said nub pins are made of material having a greater hardness than the radially inward layers of said nub pins.

5. The high-pressure roll press of claim 4 wherein said radially outward layers of said nub pins have a hardness greater than 50 Rockweld C.

6. The high-pressure roll press of claim 1 wherein each of said nub pins extend radially from said roll surface a distance substantially as great as two-thirds of the diameter of the associated nub pin adjacent said roll surface.

7. The high-pressure roll press of claim 6 wherein said nub pins taper to a diameter at their radially outer end which is slightly smaller than the diameter of said nub pins adjacent said roll surface.

* * * * *